US011780198B2

(12) United States Patent
Golbik

(10) Patent No.: US 11,780,198 B2
(45) Date of Patent: Oct. 10, 2023

(54) DEVICE FOR PRODUCING BOOK COVERS, BOX LIDS OR GAME BOARDS

(71) Applicant: KOLBUS GMBH & CO. KG, Rahden (DE)

(72) Inventor: Martin Golbik, Hille (DE)

(73) Assignee: Kolbus GmbH & Co. KG, Rahden (DE)

( * ) Notice: Subject to any disclaimer, the term of this patent is extended or adjusted under 35 U.S.C. 154(b) by 60 days.

(21) Appl. No.: 17/636,949

(22) PCT Filed: Aug. 11, 2020

(86) PCT No.: PCT/EP2020/072468

§ 371 (c)(1),
(2) Date: Feb. 21, 2022

(87) PCT Pub. No.: WO2021/032532

PCT Pub. Date: Feb. 25, 2021

(65) Prior Publication Data

US 2022/0274366 A1 Sep. 1, 2022

(30) Foreign Application Priority Data

Aug. 21, 2019 (DE) ..... 102019122509.4

(51) Int. Cl.
*B31B 50/20* (2017.01)
*B31B 50/02* (2017.01)
(Continued)

(52) U.S. Cl.
CPC ..... *B31B 50/20* (2017.08); *B26D 1/405* (2013.01); *B26D 1/435* (2013.01); *B26D 5/00* (2013.01);
(Continued)

(58) Field of Classification Search
CPC ..... B31D 1/0043; B26D 7/265; B26D 1/405; B26D 1/435; B42C 1/00
See application file for complete search history.

(56) References Cited

U.S. PATENT DOCUMENTS 4,355,554 A 10/1982 Gregory, III
4,596,541 A * 6/1986 Ward, Sr. ..... B31F 1/10 83/881

(Continued)

FOREIGN PATENT DOCUMENTS

CA 835250 A 2/1970
DE 4125508 A1 2/1993

(Continued)

OTHER PUBLICATIONS

PCT International Search Report and Written Opinion for International application No. PCT/EP2020/072468 filed Aug. 11, 2020, dated Nov. 19, 2020; 13 pgs.

*Primary Examiner* — Sean M Michalski
(74) *Attorney, Agent, or Firm* — Alix, Yale & Ristas, LLP

(57) ABSTRACT

The invention relates to a device for producing book cases, box lids or game boards with a cutting mechanism, which is arranged in the region of the blank feed and serves for cutting off the blank corners, wherein each tool pair of cutting cylinder and counterpressure cylinder is accommodated in a common bearing block and the bearing arrangement of the cutting cylinder has two mutually spaced eccentric bushes and a drive element arranged between the eccentric bushes.

20 Claims, 2 Drawing Sheets

(51) Int. Cl.

| | |
|---|---|
| ***B26D 1/40*** | (2006.01) |
| ***B26D 1/43*** | (2006.01) |
| ***B26D 5/00*** | (2006.01) |
| ***B26D 7/26*** | (2006.01) |
| ***B31D 1/00*** | (2017.01) |
| ***B42C 7/00*** | (2006.01) |

(52) U.S. Cl.
CPC ..... *B26D 7/265* (2013.01); *B31B 50/022* (2017.08); *B31D 1/0043* (2013.01); *B42C 7/008* (2013.01); *B26D 2007/2664* (2013.01)

(56) References Cited

U.S. PATENT DOCUMENTS

| | | | | |
|---|---|---|---|---|
| 5,540,128 | A * | 7/1996 | Creaden | B26D 7/2642 83/563 |
| 6,478,725 | B1 * | 11/2002 | Bengt | B65H 5/224 493/63 |
| 2015/0148940 | A1 * | 5/2015 | Ben-David | B31B 50/022 198/689.1 |
| 2019/0381753 | A1 * | 12/2019 | Fukuda | B31B 50/042 |

FOREIGN PATENT DOCUMENTS

| | | | |
|---|---|---|---|
| DE | 102010024232 | A1 | 12/2011 |
| DE | 102013208909 | A1 | 11/2014 |
| EP | 2397339 | A2 | 12/2011 |
| WO | 2006116954 | A1 | 11/2006 |

* cited by examiner

DEVICE FOR PRODUCING BOOK COVERS, BOX LIDS OR GAME BOARDS

BACKGROUND

The present invention pertains to a device according to the preamble of claim 1.

DE 102010024232A1 discloses a case maker with horizontal processing principle, which joins cover boards and a spine strip of pasteboard or cardboard with the glued blanks to be covered in a precisely fitted manner in a roll-down mechanism. The protruding edges of the book case are subsequently turned in either in a flowing throughput or at a respective standstill in successively arranged workstations. Left and right corner cut-off devices are arranged along the blank feed and serve for separating corner sections with a predefined cut-off width from the blanks to be covered on the leading and the trailing edge during the throughput of the blanks. The rotative tools of the corner cutters are driven by a servomotor that allows an electronic adjustment of the cut-off width in accordance with the respective height and opened width of the book cases.

On the one hand, the corner sections should be completely separated from the blank to be covered in order to obtain a clean blank. On the other hand, the tool wear should be kept to a minimum. This respectively requires a very precise adjustment of the axial spacing between the cutting cylinder and the counterpressure cylinder. In addition, the material properties of the blank to be covered and the respective condition of the knife and the counterpressure cylinder also have to be taken into account in this respect.

A rotary cutter for longitudinally cutting strips is known from DE4125508A1. The blade and the counter blade are respectively arranged on a shaft end. A drive element is respectively provided on the opposite shaft end. The bearing arrangement of the shafts is located between the blade and the drive element. It comprises multiple rolling bearings that are accommodated in a common bush. The bush is designed eccentrically and rotatably arranged in a frame. The rotating position of this bush in the frame defines the axial spacing of the blades in the rotary cutter.

Radial loads acting upon the shaft ends lead to elastic deformations of the shafts. In this respect, radial forces caused by the blade drive also have an effect in addition to the restoring forces caused by the cutting process. Even if the resulting inadvertent changes of the axial spacing in the cutting region are very small, the influence on the quality of the cut is in many instances significant. An angular error resulting from the bending process particularly leads to an unsatisfactory quality of the cut on drum blades of corner cutters.

The proposed arrangement only allows a parallel displacement of the rotational axes within a tool and provides no options for preventing or at least compensating the elastic deformation of the blade shafts.

Consequently, the present invention is based on the objective of developing a device that is improved in comparison with the prior art, eliminates at least one of the above-described disadvantages of the prior art and meets the increasing requirements with respect to the attainable product quality.

SUMMARY OF THE INVENTION

This objective is attained by means of an inventive device with the characteristics of claim 1. Advantageous enhancements of the invention are characterized by the features disclosed in the dependent claims.

An inventive device serves for producing book cases, box lids or game boards from at least one cardboard blank that is lined with at least one common blank to be covered. At least one region of the blank to be covered, which protrudes over the cardboard, is turned in onto the rear side about a cardboard edge. To this end, the device comprises a joining mechanism that respectively positions the cardboards and the associated pre-cut blanks to be covered relative to one another and at least sectionally glues them together.

The cardboard elements, which collectively form a product, are synchronously fed to the joining mechanism by a cardboard feed that is arranged upstream of the joining mechanism with respect to the product flow. To this end, the cardboard feed has at least one transport section. However, the cardboard feed may also comprise one or more cardboard magazines with corresponding separating mechanisms.

The blanks to be covered are fed to the joining mechanism via a transport section of the blank feed such that they respectively match the cardboards. The blank feed comprises a separating mechanism that is arranged upstream of the blank transport section. This separating mechanism respectively separates one blank sheet from a stock, e.g. a sheet stack.

A glue application mechanism is arranged on the blank transport section. This glue application mechanism divides the blank feed into a first section arranged upstream of the glue application and a second transport section arranged downstream of the glue application. The joining mechanism follows this second section viewed in the direction of the product flow. The glue application mechanism is arranged in such a way that it applies glue onto the adhesive side of the pre-cut blank to be covered during the transport motion of the blank.

At least one turn-in mechanism of conventional design is arranged downstream of the joining mechanism and turns in protrusions of the blank to be covered onto the rear side of the cardboards.

The device has at least one tool pair in the region of the first section of the blank transport, which is located upstream of the glue application mechanism. The tool pair penetrates the transport plane of the corresponding transport section of the blank feed. It is composed of a cutting cylinder and a counter cylinder.

At least the cutting cylinder has a cutting edge that projects from a cylinder surface area. The counter cylinder may be realized in the form of a counterpressure cylinder without cutting edge or likewise in the form of a cutting cylinder. Both tools of a pair are respectively rotatable about an axis. The rotational axes of a pair are aligned essentially parallel to one another and essentially perpendicular to the transport direction of the blanks to be covered. The cutting cylinder and the counter cylinder of a pair are drive-connected to one another.

The tool pair is arranged in a common bearing block. The bearing arrangement of at least one of the tools in the common bearing block comprises at least two eccentric bushes. The rotating position of the two bushes in the bearing block defines the axial spacing of the tools of a pair. The two eccentric bushes of the tool are arranged on the same side of the respective tool. In this way, opposing tool pairs can be arranged to both sides of the blank transport path and a compact structural shape of the device can thereby be achieved.

The two bushes of a tool are spaced apart from one another in the axial direction. A drive element of the drive connection of both tools of a pair is arranged between the two bushes. This leads to a rigid tool bearing arrangement. Furthermore, the arrangement of the drive connection between the bearing points causes a reduction of the axial spacing in the region of the cutting edge under driving load, particularly when cylindrical gears are used as drive connection. Widening due to the cutting forces is thereby counteracted.

In an advantageous embodiment, at least one of the eccentric bushes is drive-connected to an adjusting mechanism such that the rotating position of the eccentric bush is defined by the adjusting mechanism. In this way, the axial spacing within a tool pair can be easily and reproducibly adjusted.

This adjusting mechanism preferably has a display element, which makes available information that can be interpreted as the axial spacing. A desired axial spacing can thereby be very easily adjusted.

The eccentric bushes can be fixed in their rotating position in order to prevent an inadvertent adjustment of the axial spacing, particularly during the operation. To this end, the adjusting mechanism preferably has a self-locking gear mechanism. In this respect, it is particularly advantageous to use a worm gear that allows a very compact construction of the adjusting mechanism.

The adjusting mechanism advantageously comprises a controllable drive that is connected to the control of the device via a data link. An automated adjustment of the axial spacing can thereby be realized. Previously stored adjustments can be reproduced easily and optionally without intervention by the operating personnel.

The eccentric bushes of a tool preferably are decoupled from one another with respect to their rotating positions such that they can be adjusted individually. In this way, a deviating parallelism of the rotational axes of a tool pair can be purposefully adjusted. An adjustment, in which the rotational axes approach one another from the side of the tool facing the bearing toward the side of the tool facing away from the bearing, is particularly advantageous in this respect. In this way, the tools of a pair can be tensioned relative to one another in such a way that inadvertent non-uniform widening of the axial spacing caused by the cutting forces is compensated over the tool width. If a separate adjusting mechanism is assigned to each eccentric bush, this pretension of the tool pair can also be easily adjusted in addition to the spacing.

The cutting mechanism advantageously comprises at least one sensor for determining a value that can be interpreted as the force radially acting upon the tool. This sensor is advantageously connected to the control of the device via a data line. The radial cutting force can thereby be determined. Its increase may indicate wear of the tool. Corresponding messages can be displayed for the operating personnel. In addition, it is thereby also possible to regulate the radial force acting upon the tool in connection with the controllable adjusting mechanism. In this way, desired cutting forces can be predefined in dependence on the material.

In an advantageous embodiment, the at least one tool pair can be positioned essentially transverse to the transport direction of the blanks to be covered. In this way, different formats or cutting positions can be produced with one tool pair. In this respect, the cutting mechanism preferably has a parking or maintenance position of the tool pair outside the transport path of the blanks. It is therefore possible to disengage the tools without changing the axial spacing. This allows a reduced eccentricity of the bushes and a more precise adjustment of the axial spacing. An additional mechanism for opening the tool pair can thereby be eliminated and a compact and rigid construction can be achieved.

A simple transport mechanism transports the finished book cases, box lids or game boards out of the device and makes them available for further processing.

BRIEF DESCRIPTION OF THE DRAWINGS

Exemplary embodiments of the invention are described below with reference to the figures, to which we refer with respect to all details that are not elucidated in the description. In these figures.

DETAILED DESCRIPTION

Figure 1:
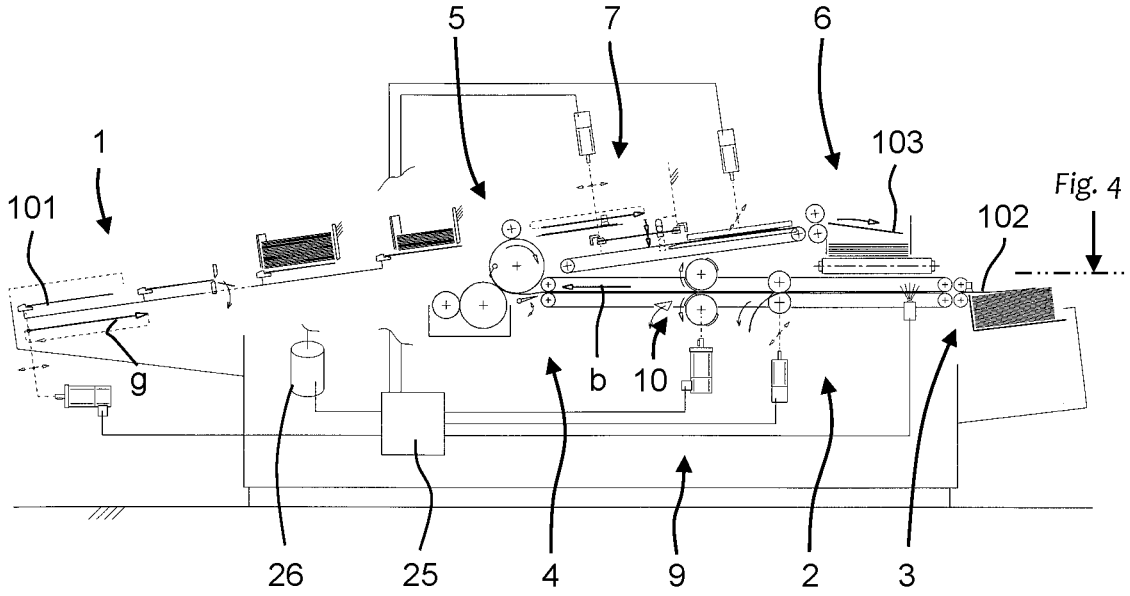
FIG. 1 shows a schematic side view of a case maker.

According to FIG. 1, an exemplary case maker comprises a cardboard feed 1 with a cardboard feed direction g, a blank feed 2 with a blank feed direction b, a case delivery 6 and multiple processing stations 4, 5, 7, 9. Viewed in the direction of the product flow, the processing stations 4, 5, 7, 9 are respectively arranged along the blank feed 2 or between the cardboard feed 1, the blank feed 2 and the case delivery 6.

A glue application mechanism 4 is located downstream of the blank feed 2. Its blank cylinder receives the pre-cut blank 105 supplied by the blank feed 2 and guides it along an application roller as far as into the joining mechanism 5. In the process, the application roller transfers glue onto the pre-cut blank 105. It would naturally also be possible to apply the glue by means of one or more application nozzles that are not illustrated in the figures.

The pre-cut blank 105 provided with glue is rolled down on one or more pre-cut cardboards 101 in the joining mechanism 5. To this end, the joining mechanism 5 has a stationary joining drum that rolls on the blank cylinder. The one or more pre-cut cardboards 101 are supplied to the joining mechanism 5 by the cardboard feed 1.

Multiple turn-in mechanisms 7 are arranged downstream of the joining mechanism 5 referred to the direction of the product flow. These turn-in mechanisms 7 respectively have multiple turn-in elements. The turn-in elements take hold of the sections of the pre-cut blanks 105 that protrude beyond the pre-cut cardboards 101, wherein said turn-in elements turn in these protruding sections as far as the inner side of the case about the outer edges of the pre-cut cardboards 101 and press them on the inner side of the case.

The delivery 6 is arranged downstream of the turn-in mechanisms 7. It receives the finished cases, stacks them, transports the case stacks out of the case maker transverse to the blank and cardboard transport directions b, g and makes them available at this location.

Figure 4:
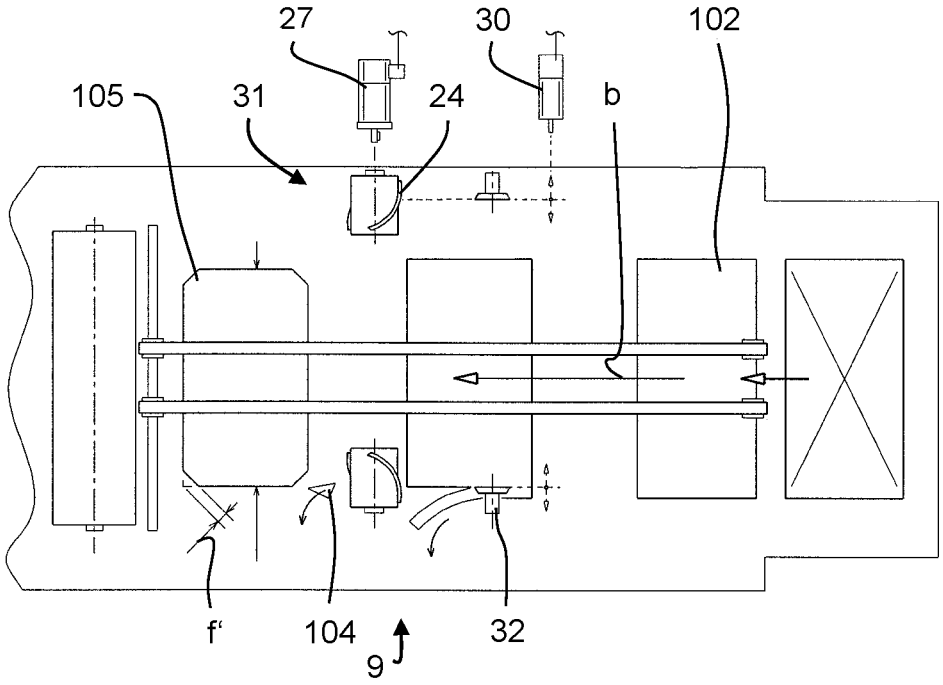
FIG. 4 shows a sectional view along the viewing direction defined in FIG. 1.

According to FIG. 4, a cutting mechanism 9 for cutting blanks to be covered 105 out of the separated blank sheets 102 is arranged in the region of the blank feed 2. A first unit consists of a rotary cutter 32. This rotary cutter penetrates the blank transport plane B in the form of a longitudinal cutting mechanism and is arranged such that its rotational axes extend transverse to the blank transport direction b. A controllable adjusting drive 30 makes it possible to position the rotary cutter 32 transverse to the blank transport direction b. In this way, blanks of different widths can be produced from identical untrimmed formats. The lateral section is removed from the blank to be covered 105 by means of not-shown guide elements of conventional design and transported away.

Figure 2:
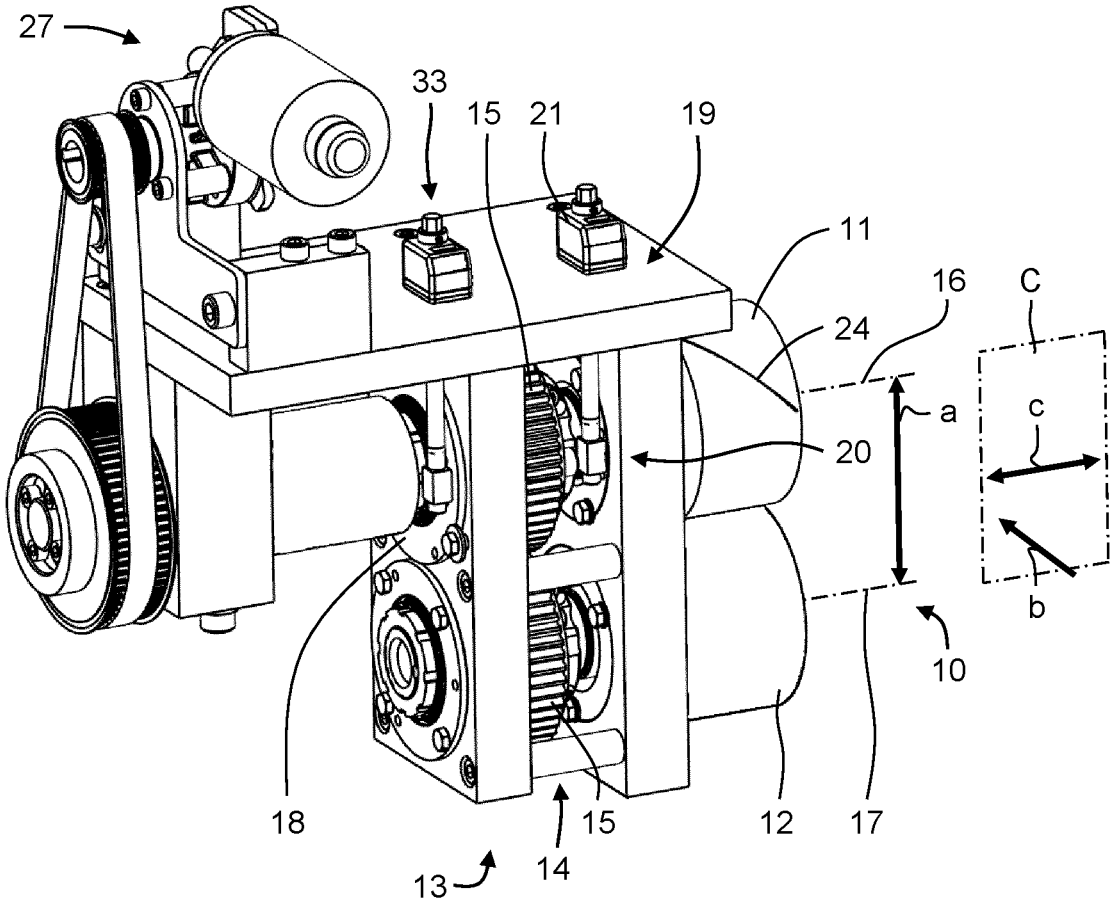
FIG. 2 shows a perspective view of a cutting mechanism for cutting off blank corners of one side.

Two cutting units, which are illustrated in FIG. 2, are arranged to both sides of the blank transport path downstream of the rotary cutter referred to the blank transport direction b. These two cutting units serve for cutting off the corners 104 of the blank sheets 102. They are designed in the form of mirror images of one another. Each cutting unit comprises a tool pair 10 consisting of a cutting cylinder 11 and a counterpressure cylinder 12. Each of these two cutting units can be positioned transverse to the blank transport direction b in accordance with the width of the blank to be covered analogous to the rotary cutters 32.

The cutting cylinder 11 arranged above the blank transport plane B is realized cylindrically and has a hard cutting edge 24 that projects from the cylinder surface area 23. This cutting edge 24 has such a helical design that its development on the blank transport plane B produces a diagonal cut.

The associated counterpressure cylinder 12, in contrast, is realized cylindrically with a smooth surface of a softer material. The end faces of the cutting cylinder 11 and the counterpressure cylinder 12 of the same tool pair 10 are aligned with one another. Both cylinders 11, 12 are accommodated in a common bearing block 13 by means of rolling bearings 34. Their rotational axes 16, 17 are aligned parallel to one another and transverse to the blank transport direction b. The rotational axes 16, 17 collectively define the tool plane C.

The cutting cylinder 11 is drive-connected to a servomotor 27 by means of a belt drive. A gear mechanism 14 consisting of cylindrical gears 15 represents the drive connection between the cutting cylinder 11 and the counterpressure cylinder.

Each of the rolling bearings 34 assigned to the cutting cylinder 11 is respectively accommodated in an eccentric bush 18. These bushes are rotatably arranged in the bearing block 13. The rotating position of the bushes 18 and their eccentricity e collectively define the axial spacing a between the cutting cylinder 11 on the one hand and the counterpressure cylinder 12 on the other hand. A small eccentricity e allows a very precise adjustment of the tool pair 10.

An adjusting mechanism 19 is respectively assigned to each eccentric bush 18 in order to achieve a comfortable operation. The use of a spindle drive 20 with a sufficiently small pitch on the one hand allows a very precise adjustment and on the other hand leads to a self-locking effect such that an inadvertent adjustment during the operation is prevented. A controllable adjusting mechanism 19 with a cylindrical gear mechanism is alternatively illustrated in FIG. 3. An adjusting mechanism according to FIG. 2 naturally can be supplemented with the controllable drive 22 illustrated in FIG. 3 such that an automated adjustment is possible in both instances.

Figure 3:
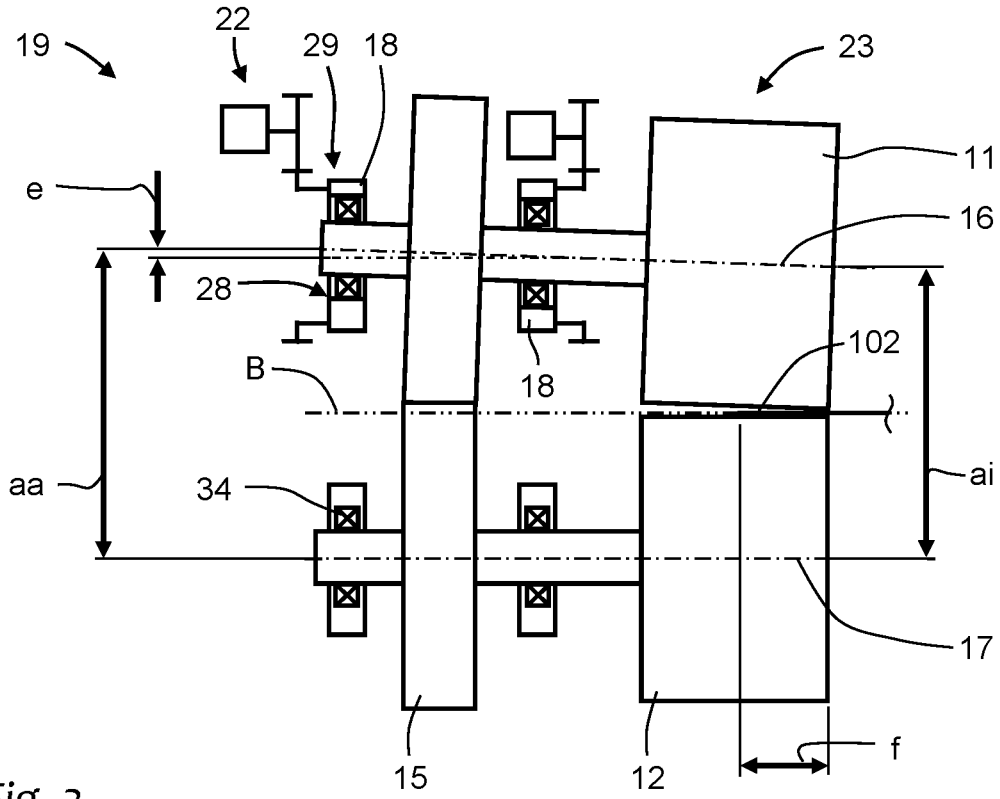
FIG. 3 shows a schematic view of a cutting mechanism for cutting off blank corners of one side.

The use of a respective adjusting mechanism 19 for each eccentric bush 18 makes it possible to purposefully adjust the rotational axes 16, 17 of the tools, 11, 12 relative to one another. FIG. 3 shows an adjustment with an outer axial spacing aa of the shaft end facing away from the cutting cylinder 11 and an inner axial spacing ai on the free end face of the cutting cylinder 11. The outer axial spacing aa is greater than the inner axial spacing ai due to the chosen rotating positions of the eccentric bushes 18.

When the blank sheet 102 passes through the tool pair 10, it widens the inner axial spacing ai due to elasticities and leads to slight bending of the rotational axis. A suitable uneven adjustment of the eccentric bushes can compensate this bending. For reasons of clarity, this inclined position in the no-load state is illustrated excessively large in FIG. 3.

The cylindrical gears 15 of the drive connection 14 between the cutting cylinder 11 and the counterpressure cylinder 12 are respectively arranged between the eccentric bushes 18. The radial forces generated by the drive lead to an increase of the axial spacing in the region of the drive connection 14 due to bending. In contrast, the inner axial spacing ai is reduced. This arrangement and the pre-adjusted inclined position according to FIG. 3 collectively compensate the increase of the inner axial spacing ai resulting from the cutting forces such that the axial spacing in the region of the cutting edge 24 is constant.

All controllable drives 22, 27, 30 are connected to the control 25 of the device via data lines. A data memory 26 is assigned to the machine control 25 such that any stored production orders can be retrieved and the associated machine adjustments, e.g. the position of the tool pairs 10, can be automatically adjusted.

The invention claimed is:

1. A device for producing book cases (103), box lids or game boards, comprising at least a first feed mechanism (1) for pre-cut cardboards (101) with a first transport direction (g), in which the pre-cut cardboards (101) are supplied, a second feed mechanism (2) for blanks to be covered (102, 105) with at least a second transport direction (b), in which the blanks to be covered (102, 105) are supplied, a separating mechanism (3) for blanks to be covered (102, 105) and a cutting mechanism (9) that is arranged downstream of the separating mechanism (3) for blanks to be covered (102, 105) referred to the second transport direction (b) of the blanks to be covered (102, 105), a glue application mechanism (4) that is arranged downstream of the second feed mechanism (2) for blanks to be covered (102, 105) referred to the second transport direction (b) of the blanks to be covered (102, 105), a joining mechanism (5) that is arranged downstream of the first feed mechanism (1) for pre-cut cardboards (101), as well as the glue application mechanism (4), referred to the material flow, a delivery mechanism (6) for pre-cut cardboards (101) lined with blanks to be covered (105), wherein said delivery mechanism is arranged downstream of the joining mechanism (5) referred to the material flow, and a cutting mechanism (9) that is arranged in the region of the second feed mechanism (2) for blanks to be covered (102, 105) and has at least a tool pair (10) that penetrates the transport plane (B) of the blanks to be covered (102, 105) and consists of a rotatable cutting cylinder (11), which has an outer surface area (23) and at least one cutting edge (24) projecting from the outer surface area (23), and a rotatable counterpressure cylinder (12) assigned to the cutting cylinder (11), wherein a first rotational axis (16) of the cutting cylinder (11) and a second rotational axis (17) of the counterpressure cylinder (12) of the tool pair (10) are arranged essentially parallel to one another and jointly arranged essentially transverse to the second transport direction (b) of the blanks to be covered (102, 105), a tool receptacle with at least one bearing block (13), in which the cutting cylinder (11) and the counterpressure cylinder (12) of the tool pair (10) are accommodated, a drive connection (14) between the counterpressure cylinder (12) and the cutting cylinder (11) of the tool pair (10), a variable axial spacing (a, aa, ai) of the first rotational axis (16) of the cutting cylinder (11) from the second rotational axis (17) of the counterpressure cylinder (12) of the tool pair (10), two bushes (18) of the tool receptacle, each bush with a respective bore (28), in which either the cutting cylinder (11) or the counterpressure cylinder (12) is accommodated and with at least one additional surface area (29), and a one-sided bearing arrangement of the cylinders (11, 12) in the bearing block (13) of the tool pair (10), wherein the two bushes (18) of the same tool (11, 12) are arranged on the same side of this tool (11, 12), wherein the bore (28) of each bush (18) is respectively arranged eccentric to the at least one additional surface area (29) of the same bush (18), the two bushes (18) respectively are rotatably accommodated in the at least one bearing block (13) with their at least one additional surface area (29) in such a way that a respective change of the rotating position of the bush (18) causes a change in the position of the rotational axis (16, 17) of the respective cutting cylinder (11) or counterpressure cylinder (12) accommodated in the bush (18), the two bushes (18) assigned to the same cylinder (11, 12) of a tool pair (10) are spaced apart from one another in the axial direction by a distance (h), and at least one drive element (15) of the drive connection (14) between the counterpressure cylinder (12) and the cutting cylinder (11) of the same tool pair (10) is arranged between the two bushes (18) assigned to this tool pair (10).

2. The device according to claim 1, comprising at least one adjusting mechanism (19) that is connected to at least one of the two bushes (18) in a rotationally active manner.

3. The device according to claim 2, comprising at least one display element (21) of the at least one adjusting mechanism (19), wherein said display element makes available information that can be interpreted as the spacing (a, aa, ai) between the rotational axes (16, 17) of the cutting cylinder (11) and the associated counterpressure cylinder (12).

4. The device according to claim 2, comprising at least one screw drive (20) of the at least one adjusting mechanism (19), wherein said screw drive acts upon the respectively assigned bush (18).

5. The device according to claim 2, comprising at least one controllable drive (22) of the at least one adjusting mechanism (19) and at least one data link between the at least one controllable drive (22) and a control (25) of the device.

6. The device according to claim 1, wherein the rotating positions of the two bushes (18) of the same tool (11, 12) can be individually adjusted.

7. The device according to claim 1, comprising an inner axial spacing (ai) between the cylinders (11, 12) of the tool pair (10) and an outer axial spacing (aa) between the cylinders (11, 12) of the tool pair (10), wherein the inner axial spacing (ai) is in the no-load state of the tool pair (10) slightly smaller than the outer axial spacing (aa) of the tool pair (10).

8. The device according to claim 1, comprising at least one sensor (33) of the cutting mechanism (9), wherein said at least one sensor acquires a value that can be interpreted as the force radially acting upon at least one cutting tool (11, 12), and at least one data link between the at least one sensor (33) and a control (25) of the device.

9. The device according to claim 1, wherein the at least one bearing block (13) with the tool pair (10) can be positioned essentially transverse to the advance direction (b) of the blanks to be covered (102, 105).

10. The device according to claim 9, comprising at least one maintenance position (31) of the tool pair (10), wherein said maintenance position is located outside a transport path of the blanks to be covered (102, 105) in such a way that the tool pair (10) has in its maintenance position (31) no effect on a blank to be covered (102, 105) being moved through the second feed mechanism (2).

11. A device for producing book cases (103), box lids or game boards, comprising:

a cutting mechanism (9) that is arranged in the region of a feed mechanism (2) for blanks to be covered (102, 105), said feed mechanism (2) moving said blanks to be covered in a transport direction (b), said cutting mechanism including, a tool pair (10) that penetrates a transport plane (B) of the blanks to be covered (102, 105) and consists of a rotatable cutting cylinder (11), which has an outer surface area (23) and at least one cutting edge (24) projecting from the outer surface area (23), and a rotatable counterpressure cylinder (12) assigned to the cutting cylinder (11), wherein a first rotational axis (16) of the cutting cylinder (11) and a second rotational axis (17) of the counterpressure cylinder (12) of the tool pair (10) are arranged essentially parallel to one another and jointly arranged essentially transverse to the transport direction (b), a tool receptacle with a bearing block (13), in which the cutting cylinder (11) and the counterpressure cylinder (12) of the tool pair (10) are accommodated, a drive connection (14) between the counterpressure cylinder (12) and the cutting cylinder (11) of the tool pair (10), a variable axial spacing (a, aa, ai) of the first rotational axis (16) of the cutting cylinder (11) from the second rotational axis (17) of the counterpressure cylinder (12) of the tool pair (10), two bushes (18) of the tool receptacle, each bush with a respective bore (28), in which either the cutting cylinder (11) or the counterpressure cylinder (12) is accommodated and with at least one additional surface area (29), and a one-sided bearing arrangement of the cylinders (11, 12) in the bearing block (13) of the tool pair (10), wherein the two bushes (18) of the same tool (11, 12) are arranged on the same side of this tool (11, 12), wherein, the bore (28) of each bush (18) is respectively arranged eccentric to the at least one additional surface area (29) of the same bush (18), the two bushes (18) respectively are rotatably accommodated in the bearing block (13) with their at least one additional surface area (29) in such a way that a respective change of the rotating position of the bush (18) causes a change in the position of the rotational axis (16, 17) of the respective cutting cylinder (11) or counterpressure cylinder (12) accommodated in the bush (18), the two bushes (18) assigned to the same cylinder (11, 12) of a tool pair (10) are spaced apart from one another in the axial direction, and a drive element (15) of the drive connection (14) between the counterpressure cylinder (12) and the cutting cylinder (11) of the tool pair (10) is arranged between the two bushes (18).

12. The device according to claim 11, comprising an adjusting mechanism (19) that is connected to at least one of the two bushes (18) in a rotationally active manner.

13. The device according to claim 12, comprising a display element (21) of the adjusting mechanism (19), wherein said display element makes available information that can be interpreted as the spacing (a, aa, ai) between the rotational axes (16, 17) of the cutting cylinder (11) and the associated counterpressure cylinder (12).

14. The device according to claim 12, comprising at least one screw drive (20) of the adjusting mechanism (19), wherein said screw drive acts upon the bush (18) to which the adjusting mechanism (19) is connected.

15. The device according to claim 12, comprising a controllable drive (22) of the adjusting mechanism (19) and at least one data link between the controllable drive (22) and a control (25) of the device.

16. The device according to claim 11, wherein the rotating positions of the at least two bushes (18) of the same tool (11, 12) can be individually adjusted.

17. The device according to claim 11, comprising an inner axial spacing (ai) between the cylinders (11, 12) of the tool pair (10) and an outer axial spacing (aa) between the cylinders (11, 12) of the tool pair (10), wherein the inner axial spacing (ai) is in a no-load state of the tool pair (10) slightly smaller than the outer axial spacing (aa) of the tool pair (10).

18. The device according to claim 11, comprising a sensor (33) of the cutting mechanism (9), wherein said sensor acquires a value that can be interpreted as the force radially acting upon the cutting cylinder (11), and a data link between the sensor (33) and a control (25) of the device.

19. The device according to claim 11, wherein the bearing block (13) with the tool pair (10) can be positioned essentially transverse to the transport direction (b).

20. The device according to claim 19, comprising a maintenance position (31) of the tool pair (10), wherein said maintenance position is located outside a transport path of the blanks to be covered (102, 105) in such a way that the tool pair (10) has in the maintenance position (31) no effect on a blank to be covered (102, 105) being moved by the feed mechanism in the transport direction (b).

* * * * *